US008422911B2

(12) United States Patent
Holmes et al.

(10) Patent No.: US 8,422,911 B2
(45) Date of Patent: Apr. 16, 2013

(54) RETAINING CLIP FOR PRINTER CARTRIDGE

(75) Inventors: Denny Holmes, Los Angeles, CA (US); Craig S. Rummler, Marina Del Rey, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 109 days.

(21) Appl. No.: 13/066,934

(22) Filed: Apr. 28, 2011

(65) Prior Publication Data

US 2011/0268470 A1 Nov. 3, 2011

Related U.S. Application Data

(60) Provisional application No. 61/343,470, filed on Apr. 29, 2010.

(51) Int. Cl.
*G03G 15/00* (2006.01)

(52) U.S. Cl.
USPC ..... 399/109; 399/113

(58) Field of Classification Search ..... 399/109, 399/110, 113, 90, 126
See application file for complete search history.

(56) References Cited

U.S. PATENT DOCUMENTS

| | | | | |
|---|---|---|---|---|
| 5,887,229 | A * | 3/1999 | Sass et al. | 399/116 |
| 6,079,084 | A * | 6/2000 | Gwynn | 24/350 |
| 6,240,605 | B1 * | 6/2001 | Stevens et al. | 24/546 |
| 6,754,460 | B2 * | 6/2004 | Lewis et al. | 399/109 |
| 7,831,171 | B2 * | 11/2010 | Holmes et al. | 399/109 |
| 2008/0003013 | A1 * | 1/2008 | Martin et al. | 399/109 |
| 2011/0044720 | A1 * | 2/2011 | Holmes et al. | 399/109 |

FOREIGN PATENT DOCUMENTS

| | | | |
|---|---|---|---|
| DE | 19936459 | A1 * | 3/2001 |
| JP | 2002268516 | A * | 9/2002 |

* cited by examiner

*Primary Examiner* — Robert Beatty

(57) ABSTRACT

In one embodiment there is provided a toner cartridge retaining clip. The retaining clip has a first end configured to engage a portion of a contact end cap of a toner cartridge, a second end configured to engage a portion of a toner hopper of the toner cartridge, and a body portion connecting the first end to the second end. The body portion has an abutting surface configured to abut a toner sensor contact on the toner cartridge. When the first end is securely engaged to the portion of the contact end cap, and the second end is securely engaged to the portion of the toner hopper, the first end and the second end exert opposing pressures on the toner cartridge to secure the contact end cap to the toner hopper.

20 Claims, 16 Drawing Sheets

RETAINING CLIP FOR PRINTER CARTRIDGE

CROSS REFERENCE TO RELATED APPLICATION

This application claims the benefit of U.S. Provisional Patent Application Ser. No. 61/343,470, filed Apr. 29, 2010, which is incorporated herein by reference in its entirety.

BACKGROUND a. Field of the Invention

The disclosure relates to printer cartridges for electrophotographic imaging devices, and in particular, to devices and methods for remanufacturing toner cartridges.

b. Background Art

Printer cartridges, such as toner cartridges, are used in various electrophotographic imaging devices, such as laser printers, copiers, facsimile machines, and multifunction imaging devices. Once original equipment manufacturer (OEM) toner cartridges are used, they are often recycled and remanufactured. The process of remanufacturing a toner cartridge may include cleaning the cartridge, repairing damaged parts, replacing worn parts, reassembling with new parts, and replenishing the cartridge with toner. The process of remanufacturing a toner cartridge requires that the toner cartridge be disassembled so that access to the various parts can be achieved, and further requires that the toner cartridge be reassembled for subsequent use.

Original equipment manufacturers (OEMs) typically orient and align the parts of an OEM toner cartridge together by ultrasonic or plastic welding. For example, toner cartridge parts that may be welded together by ultrasonic or plastic welding may include the toner hopper and the waste hopper, the end caps and the toner hopper such as the contact end cap and the toner hopper, and the end plates and the waste hopper. Such parts may also be held together with one or more fasteners, such as screws, or another type of fastener. During the remanufacturing disassembly process, the welded parts are typically detached from each other by breaking or cutting the ultrasonic or plastic welds and/or the fasteners. The breaking or cutting process may involve using conventional tools, such as blades, screw drivers, and rotary tools, in combination with force to break or cut the ultrasonic or plastic welds and/or the fasteners. As a result of such breaking or cutting, the original weld and fastener locations may not have sufficient material left to be secured with new fasteners. For example, after disassembly, threaded holes or openings may have stripped or worn threads that do not allow a fastener, such as a threaded screw, to adequately secure the disassembled toner cartridge parts back together.

In the process of remanufacturing, known devices and methods exist for securing back together disassembled toner cartridge parts such as toner hoppers and contact end caps. Such known devices and methods include using adhesives or glues to secure the disassembled toner cartridge parts back together. However, such known adhesives or glues can increase the time for remanufacturing the toner cartridge, as there is typically a waiting period of minutes or hours required for sufficient bonding of the toner cartridge parts with the adhesive or glue. Moreover, keeping the toner cartridge parts properly aligned while waiting for the adhesive or glue to bond can be challenging and can increase the overall time for remanufacturing. In addition, such adhesives or glues can bond the toner cartridge parts so strongly together that subsequent disassembly and separation for additional cycles of remanufacturing can be difficult, resulting in decreased efficiency in the remanufacturing process or possible damage to the toner cartridge. Other known devices and methods of securing disassembled toner cartridge parts back together include performing ultrasonic or plastic welding at the original weld location or at another location on the toner cartridge. However, such ultrasonic and plastic welding can be complex processes requiring expensive equipment and machinery and can increase the overall cost of remanufacturing. Moreover, such ultrasonic and plastic welding can join the toner cartridge parts so strongly together that subsequent disassembly and separation for additional cycles of remanufacturing can be difficult, resulting in decreased efficiency in the remanufacturing process or possible damage to the toner cartridge.

Accordingly, there is a need for an improved device and method for removably securing desired toner cartridge parts together, such as the contact end cap and the toner hopper, during remanufacturing of a toner cartridge that overcome the issues associated with known devices and methods.

SUMMARY

This need for an improved device and method for removably securing desired toner cartridge parts together, such as the contact end cap and the toner hopper, during remanufacturing of a toner cartridge is satisfied.

In one embodiment there is provided a toner cartridge retaining clip. The retaining clip has a first end configured to engage a portion of a contact end cap of a toner cartridge, a second end configured to engage a portion of a toner hopper of the toner cartridge, and a body portion connecting the first end to the second end. The body portion has an abutting surface configured to abut a toner sensor contact on the toner cartridge. When the first end is securely engaged to the portion of the contact end cap, and the second end is securely engaged to the portion of the toner hopper, the first end and the second end exert opposing pressures on the toner cartridge to secure the contact end cap to the toner hopper.

In another embodiment there is provided a remanufactured printer cartridge. The remanufactured printer cartridge comprises a toner hopper configured to store toner where the toner hopper has a first end and a second end. The remanufactured printer cartridge further comprises a contact end cap configured to attach to the first end of the toner hopper. The remanufactured printer cartridge further comprises a toner sensor contact adjacent the contact end cap. The remanufactured printer cartridge further comprises a retaining clip attaching the contact end cap to the first end of the toner hopper. The retaining clip comprises a first end having a curved portion configured to hook a portion of the contact end cap, a second end having an elongated portion configured to abut to a portion of the toner hopper, and a body portion connecting the first end to the second end. The body portion has an abutting surface configured to abut the toner sensor contact. The curved portion and the elongated portion exert opposing pressures on the printer cartridge to secure the contact end cap to the toner hopper.

In another embodiment there is provided a method for remanufacturing a toner cartridge. The method comprises providing a toner cartridge having a toner hopper with a depleted supply of toner, a contact end cap attached to a first end of the toner hopper, and a toner sensor contact adjacent the contact end cap. The method further comprises separating the contact end cap from the toner hopper. The method further comprises disassembling the toner hopper. The method further comprises cleaning the toner hopper. The method further comprises refilling the toner hopper with a supply of toner.

The method further comprises reassembling the refilled toner hopper. The method further comprises attaching the contact end cap to the refilled toner hopper. The method further comprises securing the contact end cap to the toner hopper with a retaining clip. The retaining clip comprises a first end configured to engage a portion of the contact end cap, a second end configured to engage a portion of the toner hopper, and a body portion connecting the first end to the second end. The body portion has an abutting surface configured to abut the toner sensor contact.

The above description broadly sets forth a summary of embodiments of the invention so that the detailed description that follows may be better understood and contributions of the disclosure to the art may be better appreciated. The features, functions, and advantages discussed herein can be achieved independently in various embodiments of the disclosure or may be combined in yet other embodiments further details of which can be seen with reference to the following description and drawings.

DESCRIPTION OF DRAWINGS

A more complete appreciation of the disclosed embodiments and many of the attendant advantages thereof will be readily obtained as the same becomes better understood by reference to the following detailed description when considered in connection with the accompanying drawings, which illustrate preferred and exemplary embodiments, but which are not necessarily drawn to scale wherein.

DETAILED DESCRIPTION

Disclosed embodiments will now be described more fully hereinafter with reference to the accompanying drawings, in which some, but not all of the disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 1:
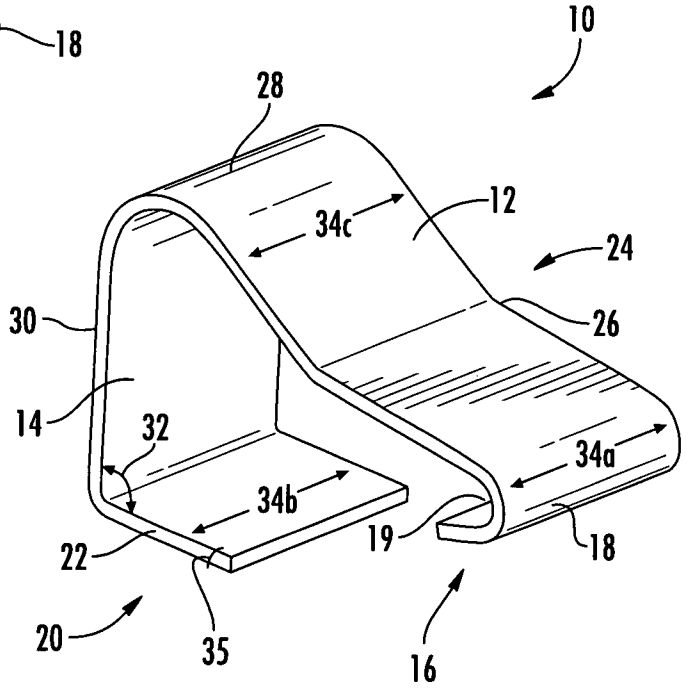
FIG. 1 is a top perspective view of one of the embodiments of the retaining clip of the disclosure.

Referring now to the Figures, as shown in FIGS. 1-6, there is provided a toner cartridge retaining clip 10. As shown in FIG. 1, the retaining clip 10 has an exterior surface 12 and an interior surface 14. Preferably, the retaining clip 10 is one piece and unitary in shape. The retaining clip 10 comprises a first end 16. The first end 16 preferably comprises a curved portion 18 that forms a hook configuration 19 in side view (see FIG. 2). The retaining clip 10 further comprises a second end 20. The second end 20 preferably comprises an elongated portion 22. The retaining clip 10 further comprises a body portion 24 that connects the first end 16 to the second end 20. The body portion 24 may have an angled section 26, a curved section 28, and an elongated section 30. The angled section 26 is preferably formed continuously with and between the curved portion 18 of the first end 16 and the curved section 28. The curved section 28 is preferably formed continuously with and between the angled section 26 and the elongated section 30. The elongated section 30 is preferably formed continuously with and between the curved section 28 and the elongated portion 22 of the second end 20. Preferably, the elongated section 30 forms a substantially 90 degree angle 32 (see FIG. 2) with the elongated portion 22 of the second side 20. It can be appreciated that the retaining clip 10 may have other varying shaped sections and configurations. The first end 16 has a width 34*a*, the second end 20 has a width 34*b*, and the body portion 24 has a width 34*c*. Preferably, the width 34*a* of the first end 16, the width 34*b* of the second end 20, and the width 34*c* of the body portion 24 are equal to each other. Preferably, the retaining clip 10 has a uniform thickness 35 (see FIG. 2) in a range of from about 0.1 mm (millimeter) to about 0.5 mm (millimeter). More preferably, the retaining clip 10 has a uniform thickness 35 of about 0.25 mm (millimeter). The retaining clip 10 is preferably comprised of a substantially rigid material such as spring steel, aluminum, resilient plastic, or another suitable substantially rigid material.

Figure 2:
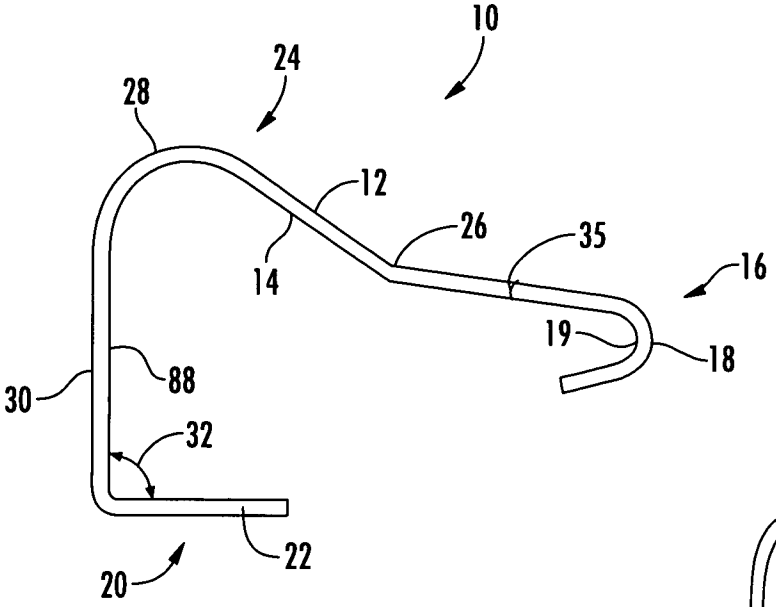
FIG. 2 is a right side view of the retaining clip of FIG. 1.
Figure 3:
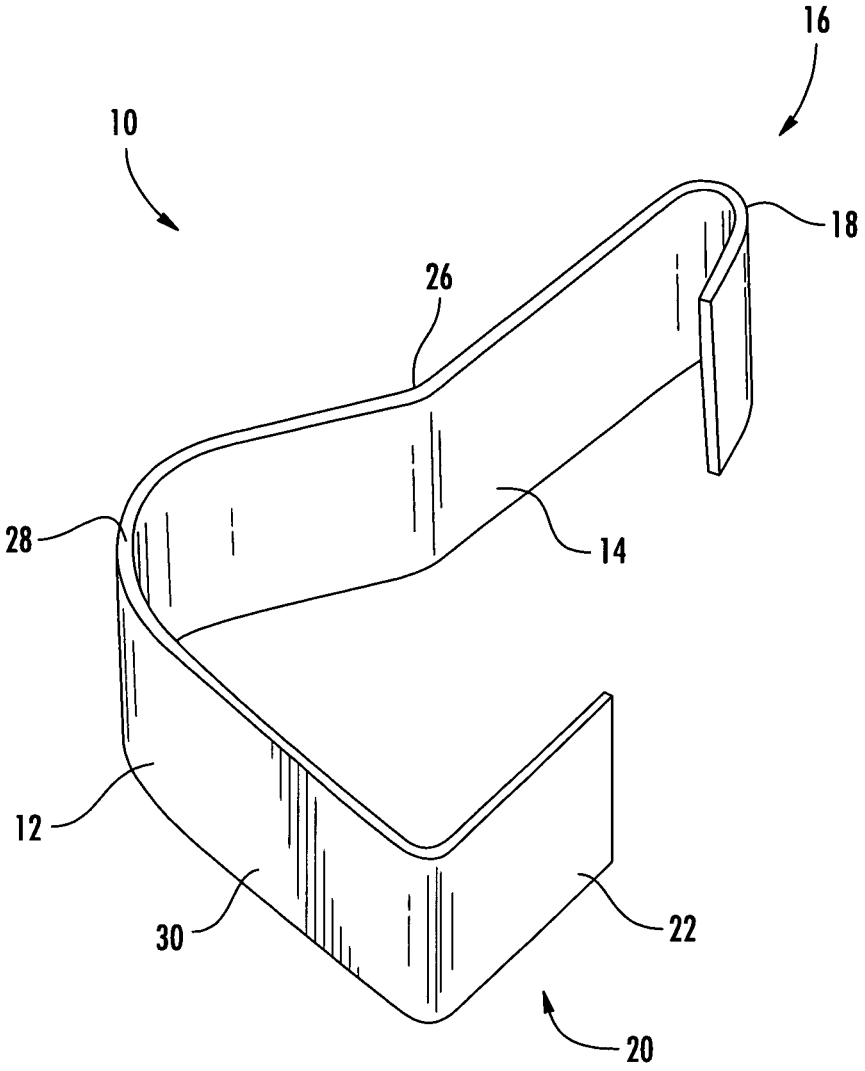
FIG. 3 is a bottom perspective view of the retaining clip of FIG. 1.
Figure 4:
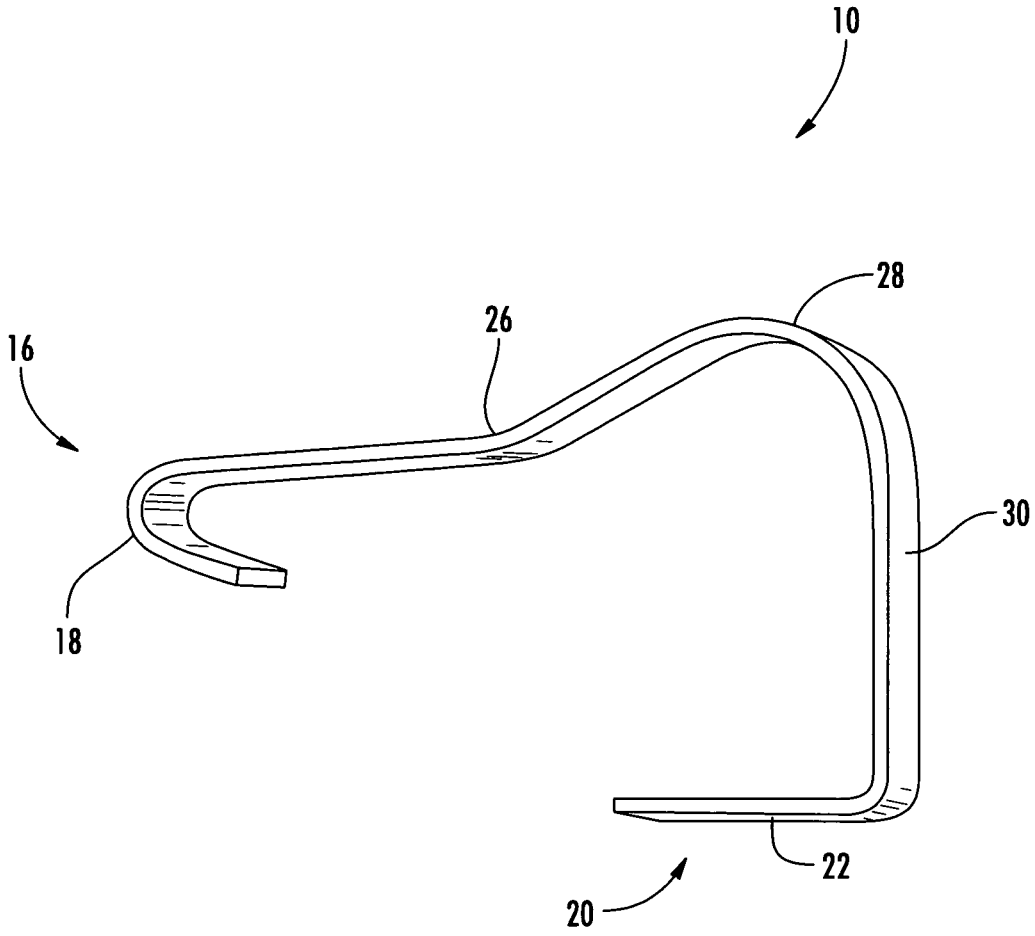
FIG. 4 is a left side perspective view of the retaining clip of FIG. 1.
Figure 5:
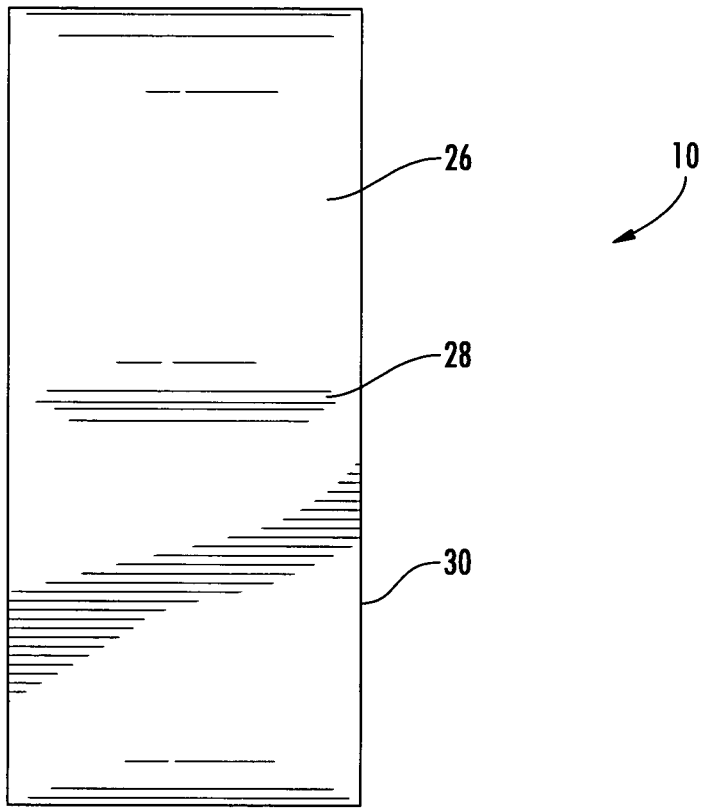
FIG. 5 is a top view of the retaining clip of FIG. 1.
Figure 6:
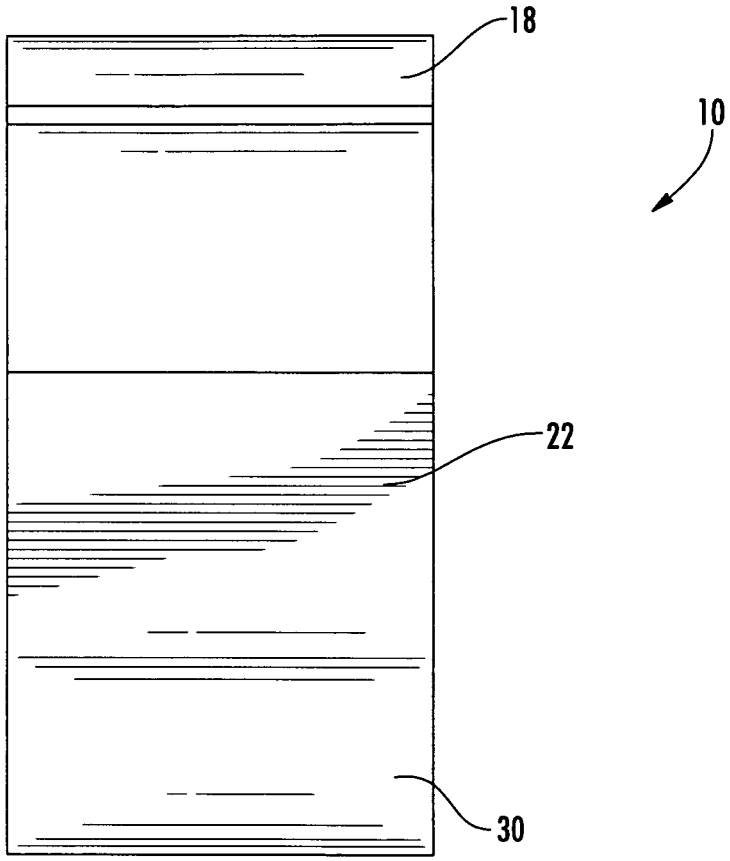
FIG. 6 is a bottom view of the retaining clip of FIG. 1.

FIG. 2 is a right side view of the retaining clip 10 of FIG. 1. FIG. 3 is a bottom perspective view of the retaining clip 10 of FIG. 1. FIG. 4 is a left side perspective view of the retaining clip 10 of FIG. 1. FIG. 5 is a top view of the retaining clip 10 of FIG. 1. FIG. 6 is a bottom view of the retaining clip 10 of FIG. 1.

The retaining clip 10 is preferably designed to be used with a toner cartridge or printer cartridge, such as the HP2055 toner cartridge manufactured by Hewlett-Packard Company, or another suitable toner or printer cartridge. Preferably, the retaining clip 10 is used with a remanufactured or used toner cartridge or printer cartridge.

Figure 7:
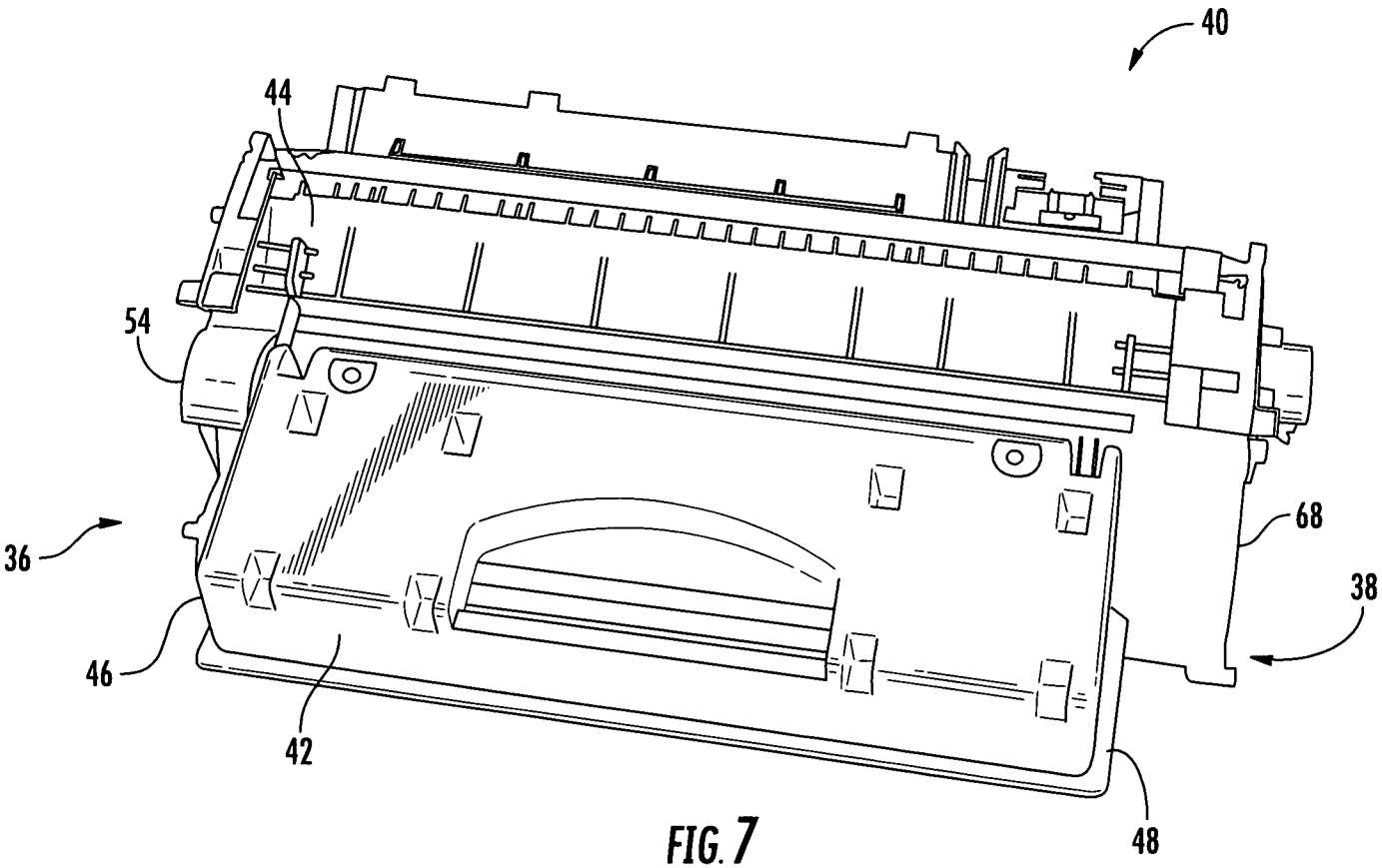
FIG. 7 (PRIOR ART)
FIG. 7 is a back perspective view of a known toner cartridge for which the retaining clip and cartridge remanufacturing method of the disclosure may be applied.

FIG. 7 is a back perspective view of a known toner cartridge 40 for which the retaining clip 10 and cartridge remanufacturing method of the disclosure may be applied. As shown in FIG. 7, the toner cartridge 40 has a first end 36 and a second end 38. The toner cartridge 40 further comprises a toner hopper 42 for storing unused toner (not shown) and a waste hopper 44 for storing waste toner (not shown). The toner hopper 42 has a first end 46 and a second end 48. As shown in FIG. 7, the toner cartridge 40 further comprises a contact end cap 54 that can be attached to the first end 46 of the toner hopper 42, and the toner cartridge 40 further comprises a gear housing end cap 68 that can be attached to the second end 48 of the toner hopper 42. The gear housing end cap 68 is designed to cover and protect one or more drive gears (not shown) that may be attached to the second end 48 of the toner hopper 42.

Figure 8:
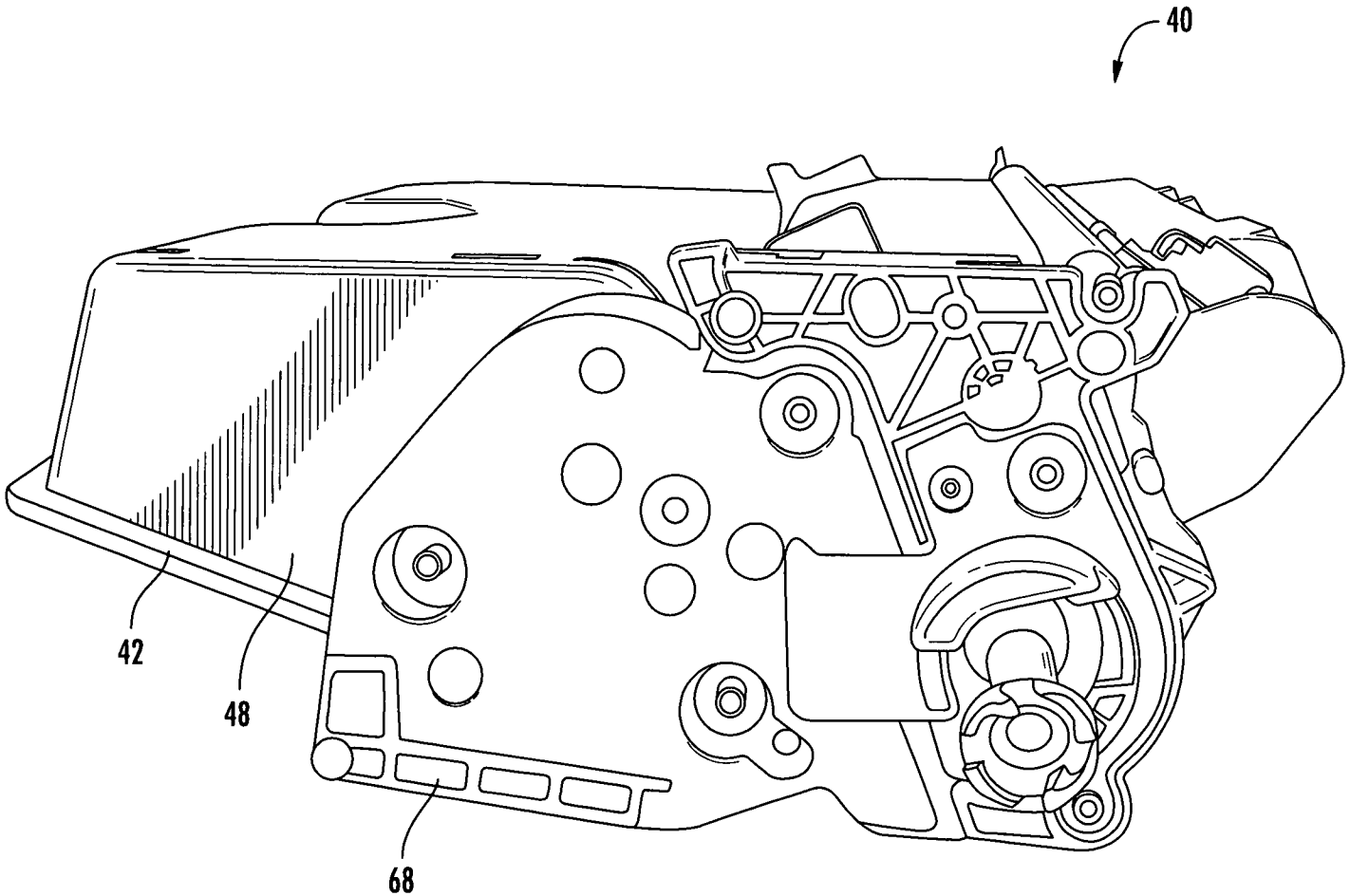
FIG. 8 (PRIOR ART)
FIG. 8 is a right side perspective view of the cartridge of FIG. 7.

FIG. 8 is a right side perspective view of the known toner cartridge 40 of FIG. 7. FIG. 8 shows the gear housing end cap 68 of the toner cartridge 40 attached to the second end 48 of the toner hopper 42.

Figure 9:
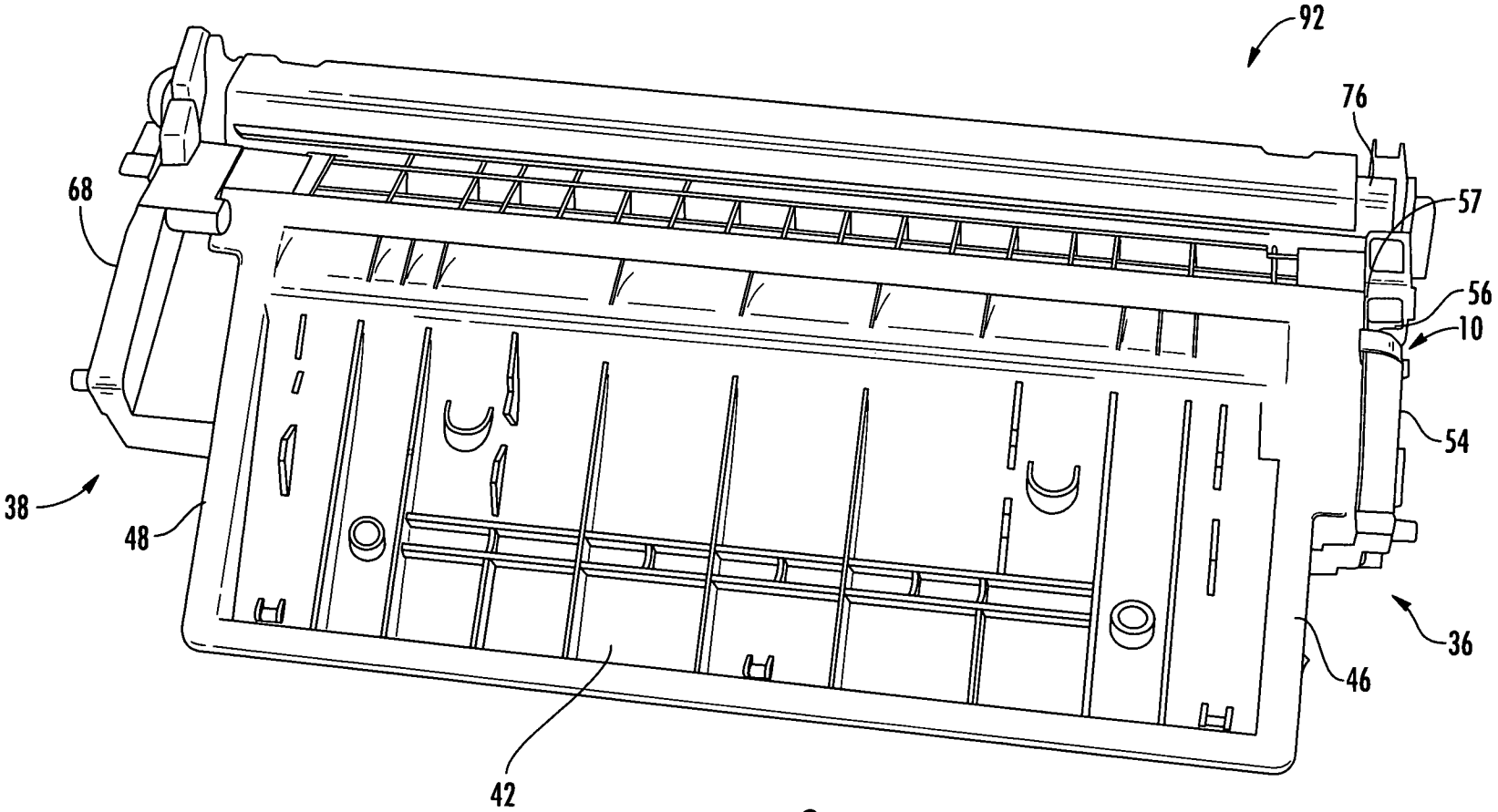
FIG. 9 is a front perspective view of a remanufactured toner cartridge with one of the embodiments of the retaining clip of the disclosure.

FIG. 9 is a front perspective view of a remanufactured toner cartridge 92 with one of the embodiments of the retaining clip 10 of the disclosure. As shown in FIG. 9, the remanufactured toner cartridge 92 comprises a first end 36 and a second end 38. The remanufactured toner cartridge 92 further comprises a toner hopper 42 for storing unused toner (not shown) and a waste hopper 44 (see FIG. 10) for storing waste toner (not shown). The toner hopper 42 has a first end 46 and a second end 48. As further shown in FIG. 9, the remanufactured toner cartridge 92 further comprises a contact end cap 54 that can be attached to the first end 46 of the toner hopper 42, and the remanufactured toner cartridge 92 further comprises a gear housing end cap 68 that can be attached to the second end 48 of the toner hopper 42. As further shown in FIG. 9, the remanufactured toner cartridge 92 further comprises one or more toner sensor contacts 56, which are preferably electrical contacts, positioned adjacent a portion 57 of the contact end cap 54. The toner sensor contacts 56 are connected to a toner sensor (not shown) located inside the remanufactured toner cartridge 92, and the toner sensor contacts 56 transfer one or more signals from the toner sensor to a printer (not shown) to indicate toner levels. The contact end cap 54 covers the first end 46 of the toner hopper 42 and also houses the toner sensor contact 56 and a mag roller contact (not shown). The remanufactured toner cartridge 92 or printer cartridge may further include an organic photoconductive drum (OPC) 76 and other printer cartridge components.

Figure 10:
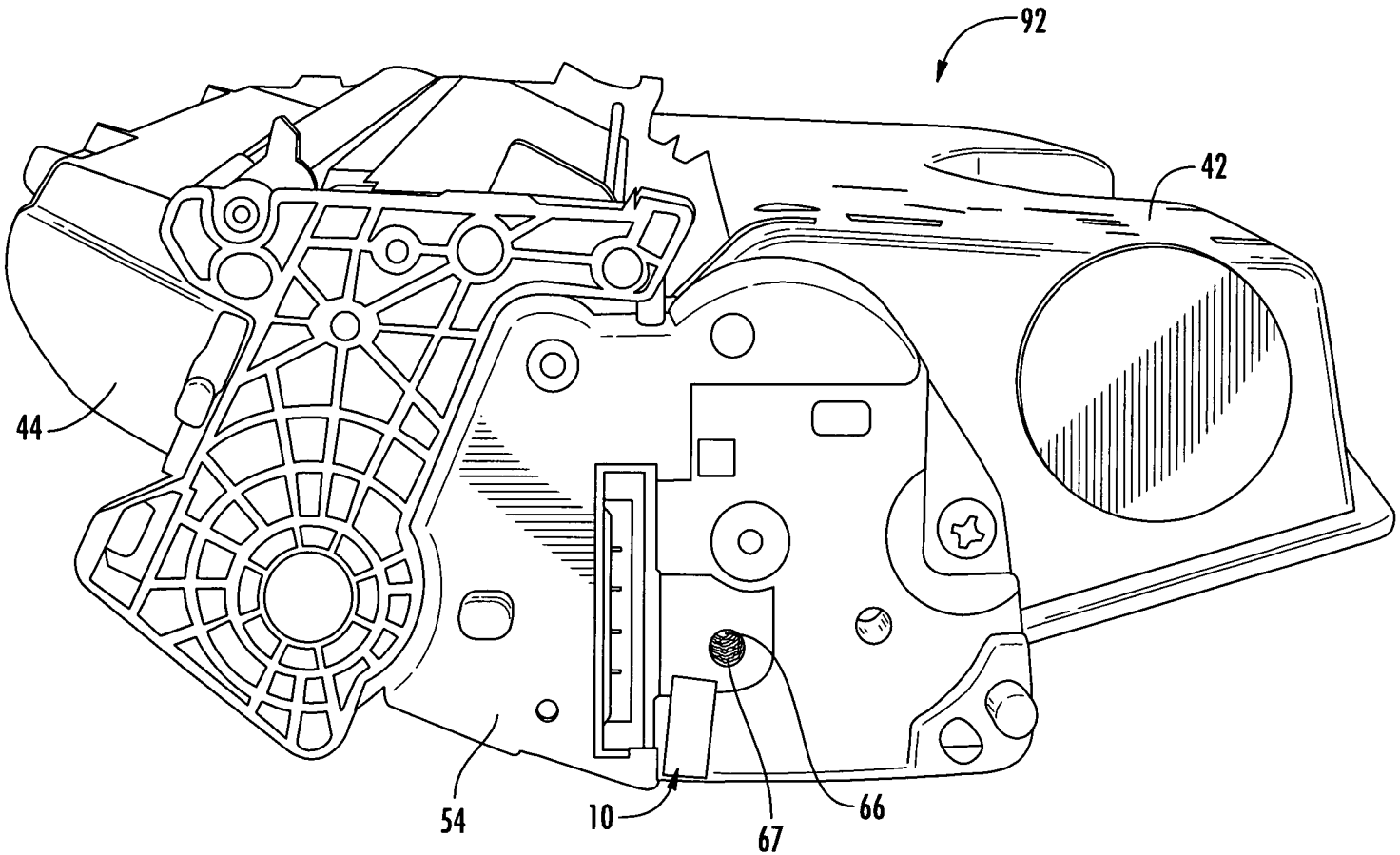
FIG. 10 is a left side perspective view of the remanufactured toner cartridge of FIG. 9.

FIG. 10 is a left side perspective view of the remanufactured toner cartridge 92 of FIG. 9. FIG. 10 shows the toner hopper 42, the waste hopper 44, and the retaining clip 10 attached to the contact end cap 54. The contact end cap 54 may have a threaded opening 66 having worn or stripped threads 67 that are likely worn or stripped as a result of disassembling the toner cartridge in order to remanufacture the toner cartridge. Such worn or stripped threads 67 typically cannot easily engage a fastener such as a threaded screw (not shown).

Figure 11:
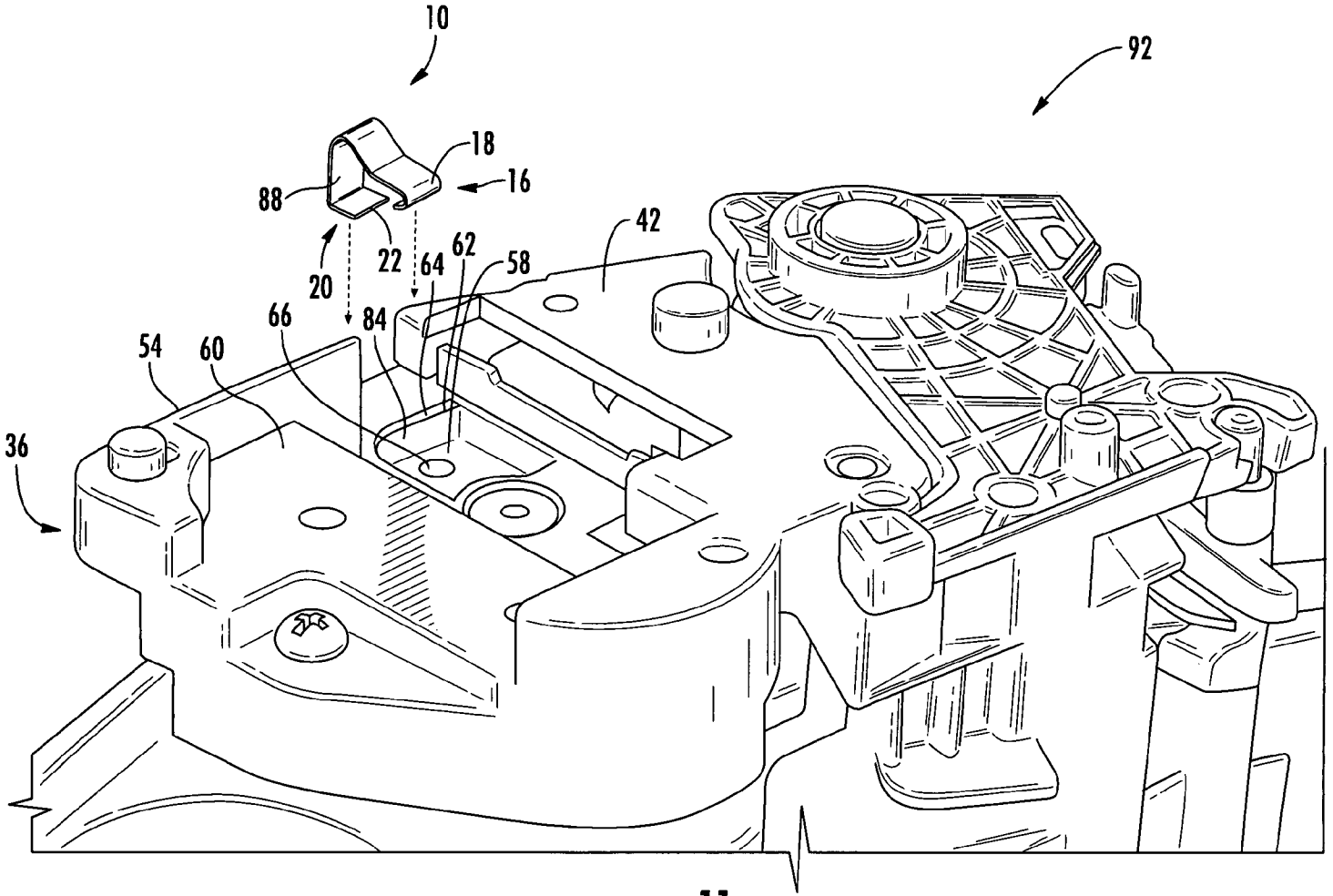
FIG. 11 is a top perspective view of one of the embodiments of the retaining clip of the disclosure being positioned for attachment to a remanufactured toner cartridge.
Figure 12:
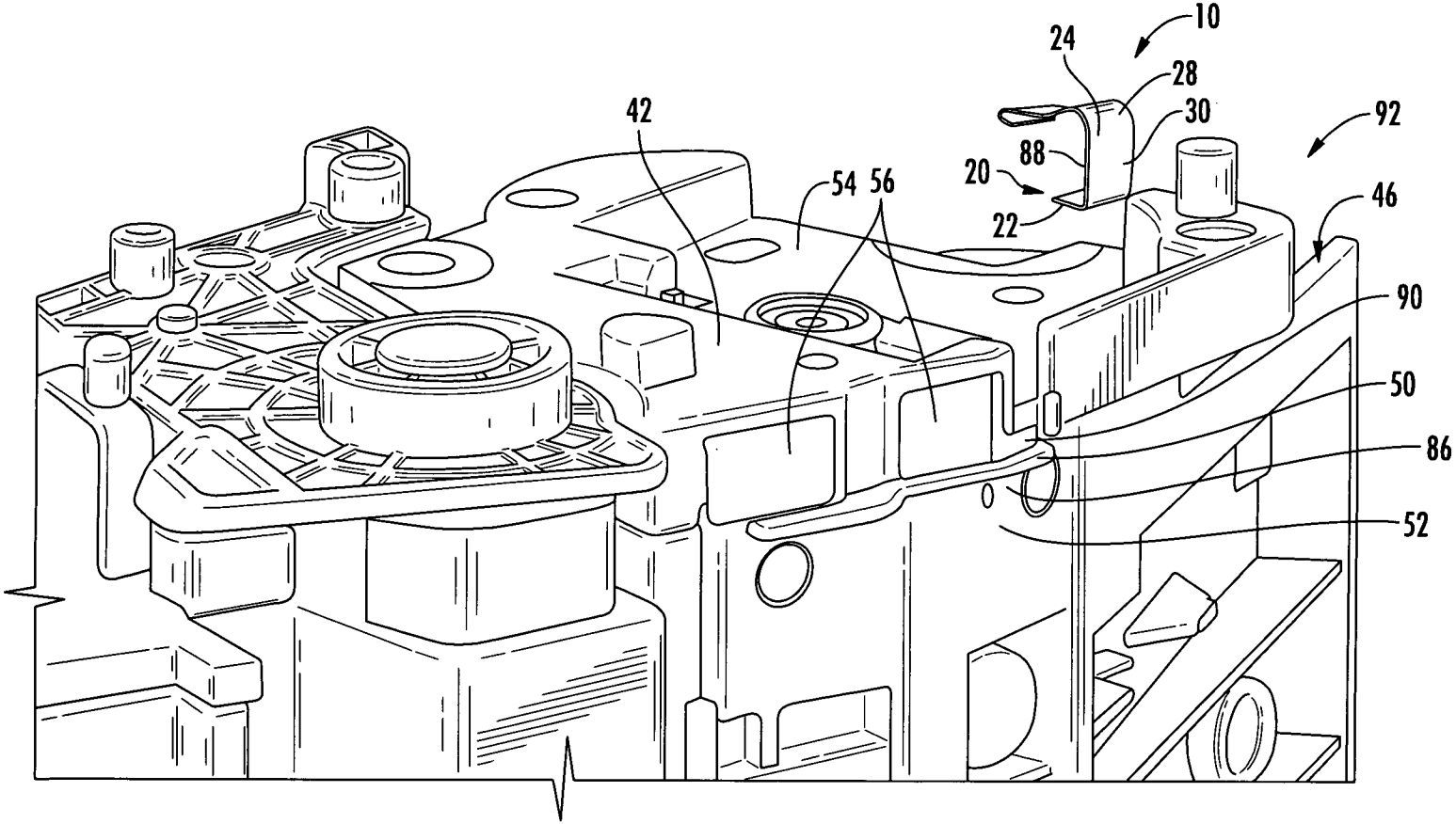
FIG. 12 is a left side perspective view of the retaining clip of FIG. 11 being positioned for attachment to the remanufactured toner cartridge.
Figure 13:
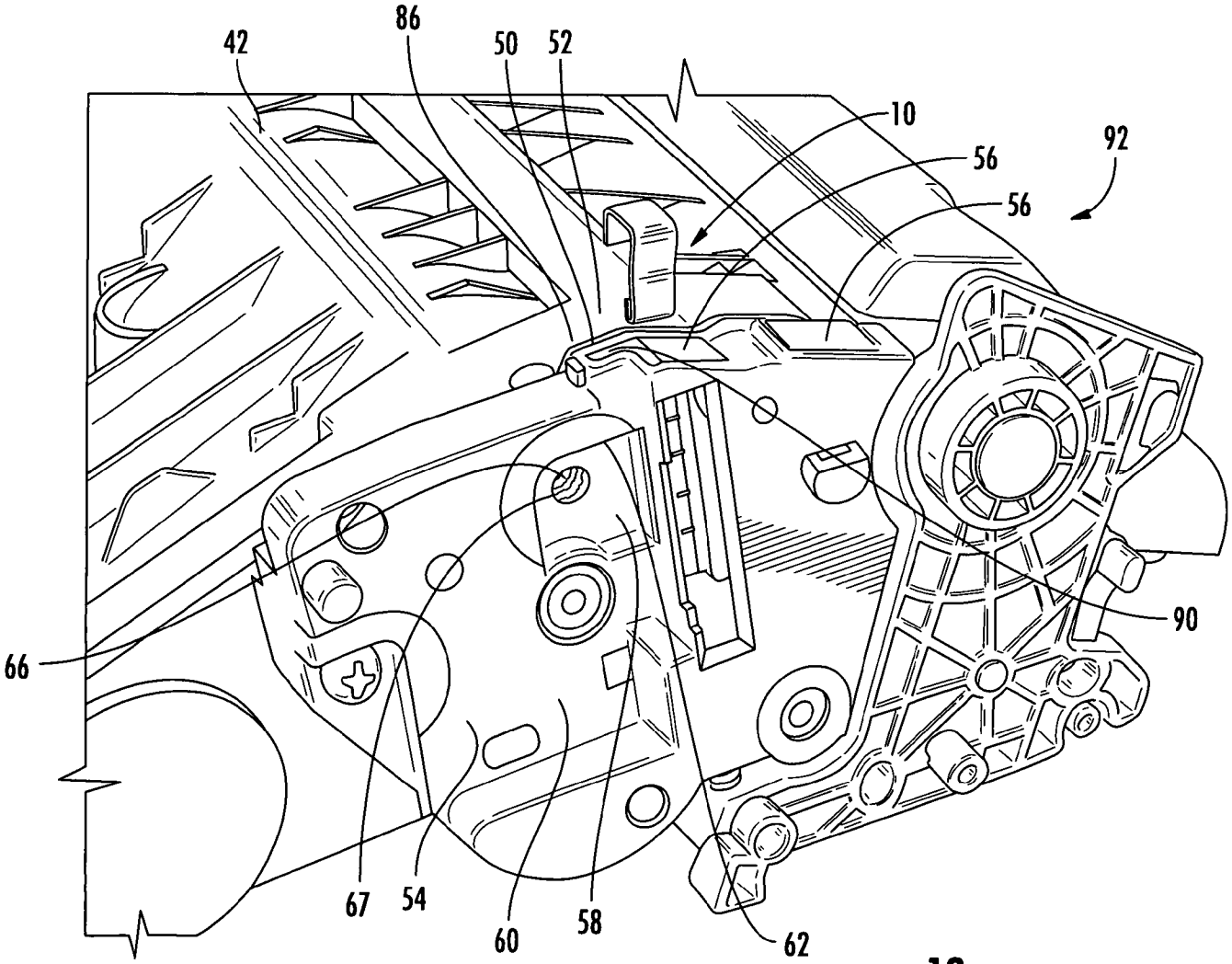
FIG. 13 is a top perspective view of the retaining clip of FIG. 11 being positioned for attachment to the remanufactured toner cartridge.

FIGS. 11-13 show the retaining clip 10 being positioned for attachment to the remanufactured toner cartridge 92. FIG. 11 is a top perspective view of one of the embodiments of the retaining clip 10 of the disclosure being positioned for attachment to the toner hopper 42 and the contact end cap 54 of the remanufactured toner cartridge 92 during remanufacturing of the remanufactured toner cartridge 92. FIG. 11 shows the curved portion 18 of the first end 16 of the retaining clip 10, the abutting surface 88 of the retaining clip 10, and the elongated portion 22 of the second end 20 of the retaining clip 10. The curved portion 18 of the first end 16 of the retaining clip 10 is preferably configured to engage a portion 84 of the contact end cap 54, the contact end cap 54 being located at the first end 36 of the remanufactured toner cartridge 92. As shown in FIG. 11, the contact end cap 54 preferably comprises a recessed portion 58 formed in an exterior surface 60 of the contact end cap 54. The recessed portion 58 preferably has a recessed lip 62 formed along an edge 64 of the recessed portion 58. FIG. 11 further shows the contact end cap 54 with the threaded opening 66 having worn or stripped threads 67.

FIG. 12 is a left side perspective view of the retaining clip 10 of FIG. 11 being positioned for attachment to the toner hopper 42 and the contact end cap 54 of the remanufactured toner cartridge 92. FIG. 12 shows the curved section 28 and elongated section 30 of the body portion 24 of the retaining clip 10, the abutting surface 88 of the retaining clip 10, and the elongated portion 22 of the second end 20 of the retaining clip 10. The elongated portion 22 of the second end 20 of the retaining clip 10 is preferably configured to engage a portion 86 on the first end 46 of the toner hopper 42 of the remanufactured toner cartridge 92. Preferably, the portion 86 comprises the protruding edge portion 50 formed on the exterior surface 52 of the first end 46 of the toner hopper 42. The abutting surface 88 of the body portion 24 is configured to abut a portion 90 of the toner sensor contact 56 on the remanufactured toner cartridge 92.

FIG. 13 is a top perspective view of the retaining clip 10 of FIG. 11 being positioned for attachment to the toner hopper 42 and the contact end cap 54 of the remanufactured toner cartridge 92. FIG. 13 shows the portion 86 comprising the protruding edge portion 50 formed on the exterior surface 52 of the toner hopper 42, the portion 90 of the toner sensor contact 56, the recessed lip 62 of the recessed portion 58 of the contact end cap 54, the exterior surface 60 of the contact end cap 54, and the threaded opening 66 with the worn or stripped threads 67.

When the first end 16 of the retaining clip 10 is securely engaged to the recessed portion 58 of the contact end cap 54, and the second end 20 of the retaining clip 10 is securely engaged to the protruding edge portion 50 of the toner hopper 42, the first end 16 and the second end 20 exert opposing pressures on the toner cartridge 40 to secure the contact end cap 54 to the toner hopper 42. The retaining clip 10 is preferably removable from the toner cartridge 40 after securing the contact end cap 54 to the toner hopper 42, so that the toner cartridge 40 may be used in one or more subsequent cycles of remanufacturing of the remanufactured toner cartridge 92 or the toner cartridge 40. The retaining clip 10 is preferably of a substantially rigid material and of a suitable configuration to insure that the contact end cap 54 is securely attached to the toner hopper 42. Secure attachment of the contact end cap 54 helps to maintain proper alignment of the mag roller (not shown) within the remanufactured toner cartridge 92 or the toner cartridge 40 and helps to maintain proper positioning of the toner sensor contact 56.

Figure 14:
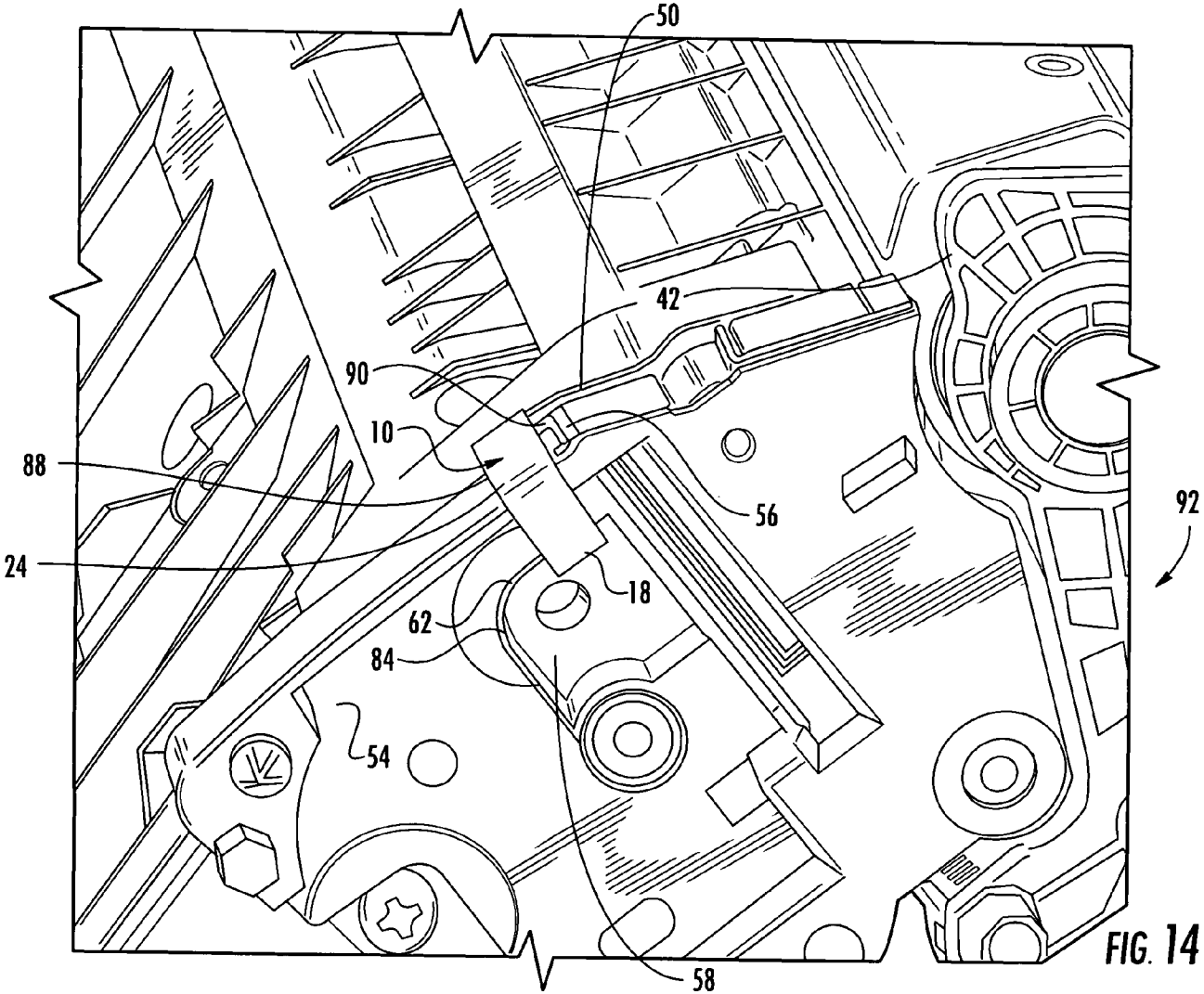
FIG. 14 is a top perspective view of one of the embodiments of the retaining clip of the disclosure attached to a remanufactured toner cartridge.
Figure 15:
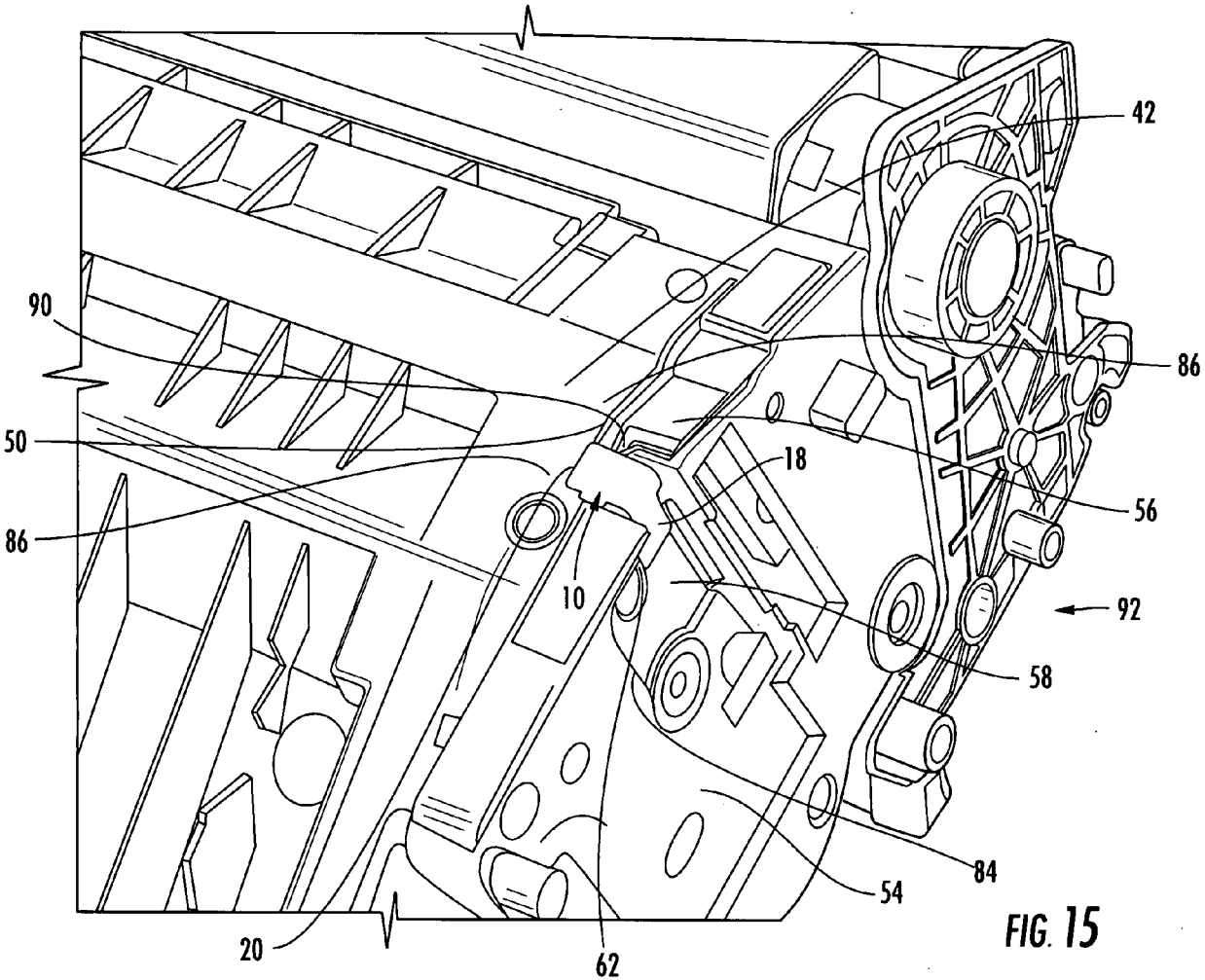
FIG. 15 is a back perspective view of the retaining clip of FIG. 14 attached to the remanufactured toner cartridge.
Figure 16:
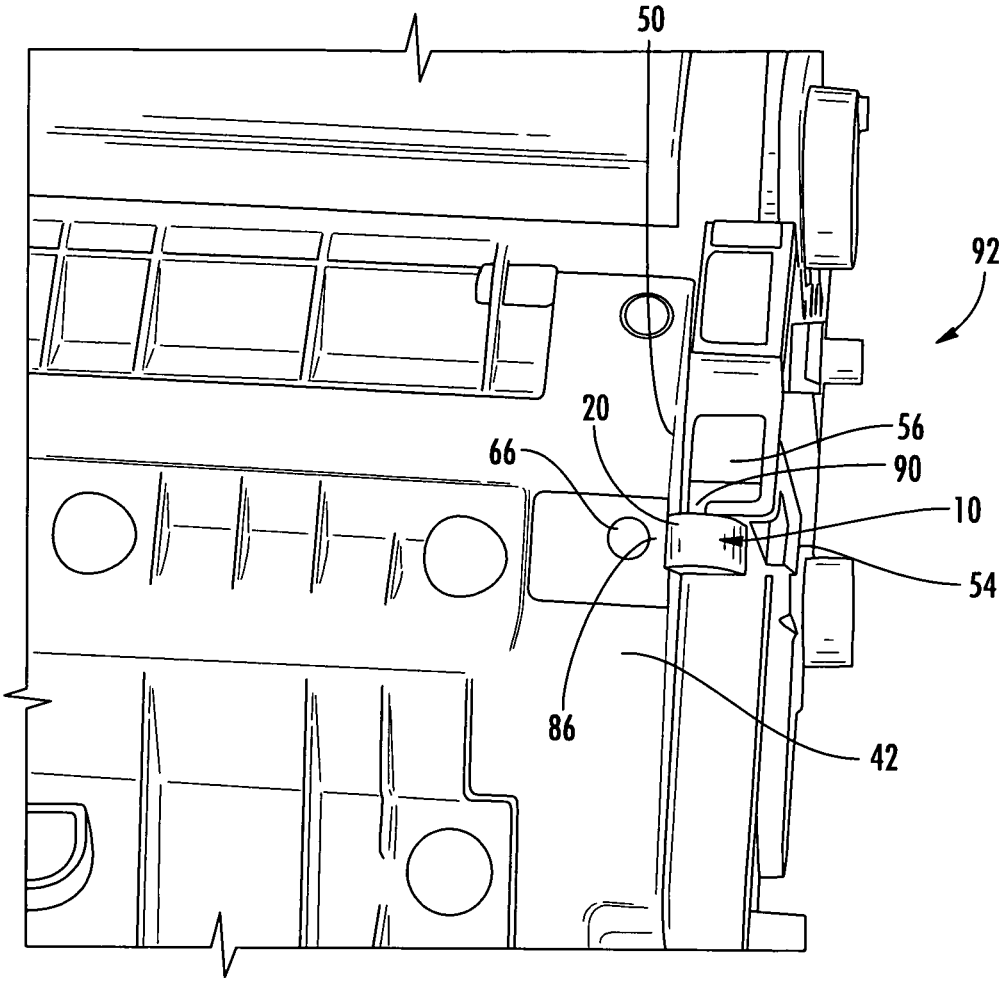
FIG. 16 is a back view of the retaining clip of FIG. 14 attached to the remanufactured toner cartridge; and, FIG. 17 is a flow diagram of one of the disclosed embodiments of a method for remanufacturing a toner cartridge using one of the embodiments of the retaining clip of the disclosure.

As shown in FIGS. 14-16, the retaining clip 10 is attached to the remanufactured printer cartridge 92. FIG. 14 is a top perspective view of one of the embodiments of the retaining clip 10 of the disclosure attached to the remanufactured toner cartridge 92. FIG. 14 shows the curved portion 18 of the retaining clip 10 attached to the portion 84 of the contact end cap 54 where the portion 84 comprises the recessed lip 62 of the recessed portion 58, shows the abutting surface 88 of the body portion 24 of the retaining clip 10 abutting the portion 90 of the toner sensor contact 56, and shows second end 20 of the retaining clip 10 attached to the portion 86 on the toner hopper 42 where the portion comprises the protruding edge portion 50 formed on the toner hopper 42.

FIG. 15 is a back perspective view of the retaining clip 10 of FIG. 14 attached to the remanufactured toner cartridge 92. FIG. 15 shows the curved portion 18 of the retaining clip 10 attached to the portion 84 of the contact end cap 54 where the portion 84 comprises the recessed lip 62 of the recessed portion 58 of the contact end cap 54, shows the abutting surface 88 of the body portion 24 of the retaining clip 10 abutting the portion 90 of the toner sensor contact 56, and shows second end 20 of the retaining clip 10 attached to the portion 86 on the toner hopper 42 where the portion comprises the protruding edge portion 50 formed on the toner hopper 42.

FIG. 16 is a back view of the retaining clip 10 of FIG. 14 attached to the remanufactured toner cartridge 92. FIG. 16 shows the abutting surface 88 of the body portion 24 of the retaining clip 10 abutting the portion 90 of the toner sensor contact 56, and shows second end 20 of the retaining clip 10 attached to the portion 86 on the toner hopper 42 where the portion comprises the protruding edge portion 50 formed on the toner hopper 42.

The remanufactured printer cartridge 92 comprises the toner hopper 42 configured to store toner, where the toner hopper 42 has the first end 46 and the second end 48. The remanufactured printer cartridge 92 further comprises the contact end cap 54 configured to attach to the first end 46 of the toner hopper 42. The remanufactured cartridge 92 further comprises the toner sensor contact 56 positioned adjacent the contact end cap 54. The remanufactured printer cartridge 92 further comprises the retaining clip 10 that attaches the contact end cap 54 to the first end 46 of the toner hopper 42. The retaining clip 10, as discussed above, comprises the first end 16 having the curved portion 18 configured to hook the portion 84 of the contact end cap 54, the second end 20 having the elongated portion 22 configured to abut to the portion 86 of the toner hopper 42, and the body portion 24 connecting the first end 16 to the second end 20. The body portion 24 has the abutting surface 88 configured to abut the toner sensor contact 56 on the remanufactured printer cartridge 92. The curved portion 18 and the elongated portion 22 exert opposing pressures on the remanufactured printer cartridge 92 to secure the contact end cap 54 to the toner hopper 42. The portion 84 of the contact end cap 54 that is hooked by the curved portion 18 of the first end 16 of the retaining clip 10 comprises the recessed lip 62 formed in the exterior surface 60 of the contact end cap 54. The portion 86 of the toner hopper 42 that is abutted by the elongated portion 22 of the second end 20 of the retaining clip 10 comprises the protruding edge 50 formed on the exterior surface 52 of the toner hopper 42. After securing the contact end cap 54 to the toner hopper 42, the retaining clip 10 may be removed from the remanufactured printer cartridge 92 during subsequent remanufacturing cycles.

Figure 17:
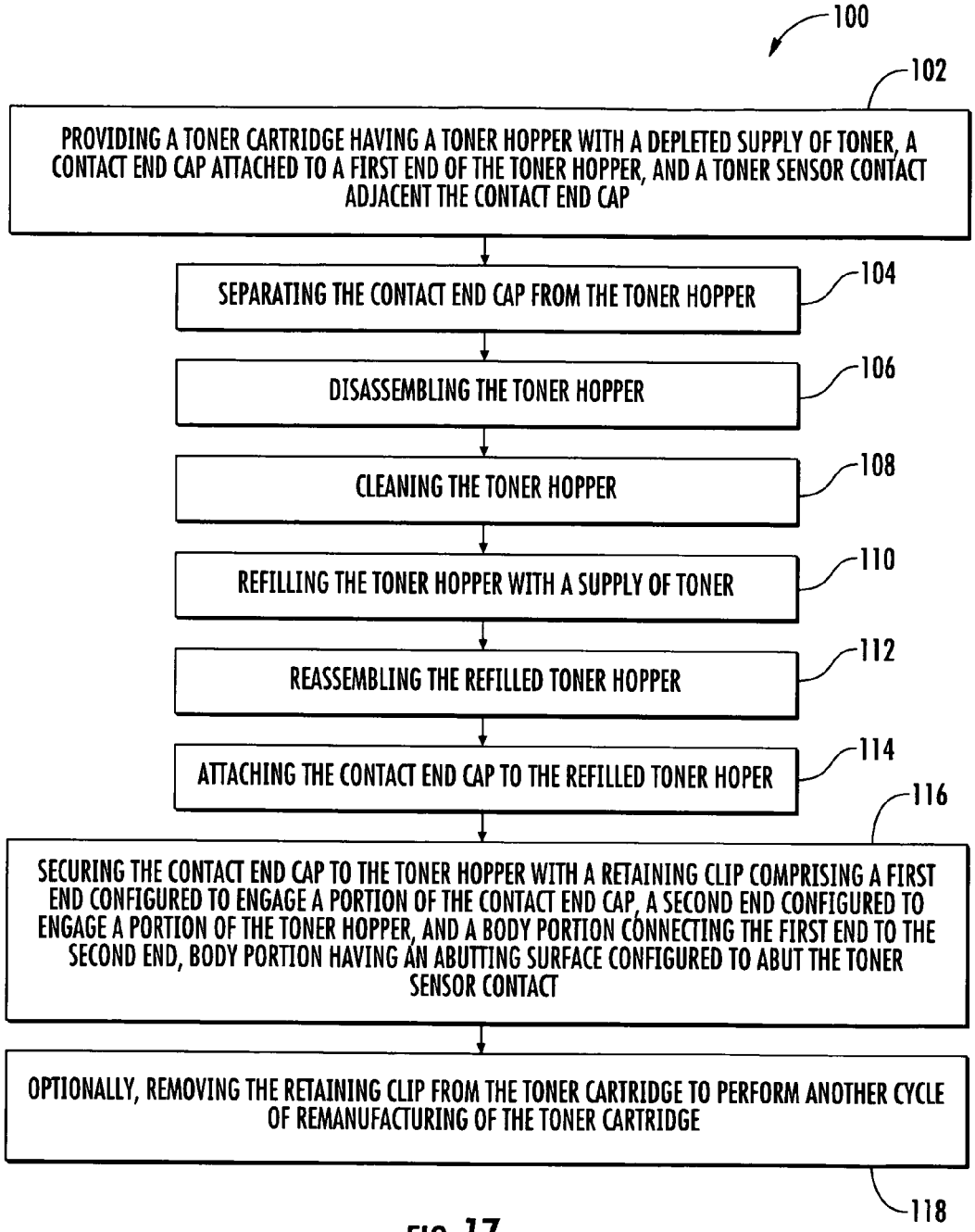

In another embodiment there is provided a method for remanufacturing a toner cartridge. FIG. 17 is a flow diagram of one of the disclosed embodiments of a method 100 for remanufacturing a toner cartridge 40 (see FIGS. 7-8) or printer cartridge, preferably a remanufactured cartridge 92 (see FIGS. 9-16) using one of the embodiments of the retaining clip 10 of the disclosure. The method 100 comprises step 102 of providing a toner cartridge 40 or remanufactured toner cartridge 92 having a toner hopper 42 with a depleted supply of toner, a contact end cap 54 attached to a first end 46 of the toner hopper 42, and the toner sensor contact 56 adjacent the contact end cap 54. The method 100 further comprises step 104 of separating the contact end cap 54 from the toner hopper 42. The method 100 further comprises step 106 of disassembling the toner hopper 42. The method 100 further comprises step 108 of cleaning the toner hopper 42. The method 100 further comprises step 110 of refilling the toner hopper 42 with a supply of toner (not shown) to result in or form a toner hopper 42 that is refilled. The method 100 further comprises step 112 of reassembling the refilled toner hopper 42. The method 100 further comprises step 114 of attaching the contact end cap 54 to the refilled toner hopper 42. The method 100 further comprises step 116 of securing the contact end cap 54 to the toner hopper 42 with the retaining clip 10. As discussed above, one of the embodiments of the disclosed retaining clip 10 comprises first end 16 configured to engage portion 84 of the contact end cap 54, second end 20 configured to engage portion 86 of the toner hopper 42, and body portion 24 connecting the first end 16 to the second end 20. The portion 84 of the contact end cap 54 comprises a recessed lip 62 formed in the exterior surface 60 of the contact end cap 54. The portion 86 of the toner hopper 42 comprises a protruding edge 50 formed on the exterior surface 52 of the toner hopper 42. The body portion 24 has abutting surface 88 configured to abut the toner sensor contact 56. The first end 16 of the retaining clip 10 is securely engaged to the portion 84 of the contact end cap 54, and the second end 20 of the retaining clip 10 is securely engaged to the portion 86 of the toner hopper 42. The first end 16 and the second end 20 exert opposing pressures on the toner cartridge 40 to secure the contact end cap 54 to the toner hopper 42. The method 100 may further optionally comprise after the step 116 of securing the contact end cap 54 to the toner hopper 42 with the retaining clip 10, the step 118 of removing the retaining clip 10 from the toner cartridge 40 to perform one or more subsequent cycles of remanufacturing of the toner cartridge 40 or remanufactured toner cartridge 92.

Embodiments disclosed herein for the retaining clip 10 for use with the remanufactured toner cartridge 92 or toner cartridge 40 provides a retaining clip 10 that secures and retains the contact end cap 54 to the toner hopper 42 of the remanufactured toner cartridge 92 or toner cartridge 40, helps preserve the appearance of the remanufactured printer cartridge 92 or the toner cartridge 40, minimizes remanufacturing steps, extends the life of the remanufactured printer cartridge 92 or toner cartridge 40, and allows a printer cartridge remanufacturer to easily separate the contact end cap 54 from the toner hopper 42 during one or more subsequent remanufacturing cycles of the remanufactured toner cartridge 92 or toner cartridge 40. Embodiments of the disclosed device and method provide for a removable retaining clip 10 that securely joins the contact end cap 54 of the toner cartridge 40 to the toner hopper 42 of the toner cartridge 40 without sacrificing durability and efficiency.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation.

What is claimed is:

1. A toner cartridge retaining clip comprising:

a first end configured to engage a portion of a contact end cap of a toner cartridge, the contact end cap housing a toner sensor contact;

a second end configured to engage a portion of a toner hopper of the toner cartridge; and, a body portion connecting the first end to the second end, the body portion having an angled section, a curved section, and an elongated section and further having an abutting surface configured to abut the toner sensor contact, wherein when the first end is securely engaged to the portion of the contact end cap and the second end is securely engaged to the portion of the toner hopper, the first end and the second end exert opposing pressures on the toner cartridge to secure the contact end cap to the toner hopper.

2. The toner cartridge retaining clip of claim 1, wherein the retaining clip is unitary in shape.

3. The toner cartridge retaining clip of claim 1, wherein the first end comprises a curved portion.

4. The toner cartridge retaining clip of claim 1, wherein the second end comprises an elongated portion.

5. The toner cartridge retaining clip of claim 1, wherein the portion of the contact end cap comprises a recessed lip formed in an exterior surface of the contact end cap.

6. The toner cartridge retaining clip of claim 1, wherein the portion of the toner hopper comprises a protruding edge formed on an exterior surface of the toner hopper.

7. The toner cartridge retaining clip of claim 1, wherein the retaining clip is comprised of a material selected from the group consisting of spring steel, aluminum, and resilient plastic.

8. The toner cartridge retaining clip of claim 1, wherein the first end, the second end, and the body portion each comprises a width, the widths of the first end, the second end, and the body portion being equal to each other.

9. The toner cartridge retaining clip of claim 1, wherein the retaining clip is removable from the toner cartridge after securing the contact end cap to the toner hopper.

10. A remanufactured printer cartridge comprising:

a toner hopper configured to store toner, the toner hopper having a first end and a second end;

a contact end cap housing a toner sensor contact and configured to attach to the first end of the toner hopper; and, a retaining clip attaching the contact end cap to the first end of the toner hopper, the retaining clip comprising:

a first end having a curved portion configured to hook a portion of the contact end cap;

a second end having an elongated portion configured to abut to a portion of the toner hopper; and, a body portion connecting the first end to the second end, the body portion having an abutting surface configured to abut the toner sensor contact, wherein the curved portion and the elongated portion exert opposing pressures on the printer cartridge to secure the contact end cap to the toner hopper.

11. The remanufactured printer cartridge of claim 10, wherein the retaining clip is unitary in shape.

12. The remanufactured printer cartridge of claim 10, wherein the portion of the contact end cap that is hooked by the curved portion of the first end of the retaining clip comprises a recessed lip formed in an exterior surface of the contact end cap.

13. The remanufactured printer cartridge of claim 10, wherein the portion of the toner hopper that is abutted by the elongated portion of the second end of the retaining clip comprises a protruding edge formed on an exterior surface of the toner hopper.

14. The remanufactured printer cartridge of claim 10, wherein the retaining clip is removable from the remanufactured printer cartridge after securing the contact end cap to the toner hopper.

15. A method for remanufacturing a toner cartridge comprising:

providing a toner cartridge having a toner hopper with a depleted supply of toner, a contact end cap housing a toner sensor contact and attached to a first end of the toner hopper, separating the contact end cap from the toner hopper;

disassembling the toner hopper;

cleaning the toner hopper;

refilling the toner hopper with a supply of toner;

reassembling the refilled toner hopper;

attaching the contact end cap to the refilled toner hopper;

securing the contact end cap to the toner hopper with a retaining clip comprising:

a first end configured to engage a portion of the contact end cap;

a second end configured to engage a portion of the toner hopper; and, a body portion connecting the first end to the second end, the body portion having an abutting surface configured to abut the toner sensor contact.

16. The method of claim 15 further comprising after securing the contact end cap to the toner hopper with the retaining clip, removing the retaining clip from the toner cartridge to perform a subsequent cycle of remanufacturing of the toner cartridge.

17. The method of claim 15, wherein when the first end of the retaining clip is securely engaged to a portion of the contact end cap and the second end of the retaining clip is securely engaged to a portion of the toner hopper, the first end and the second end exert opposing pressures on the toner cartridge to secure the contact end cap to the toner hopper.

18. The method of claim 15, wherein the portion of the contact end cap comprises a recessed lip formed in an exterior surface of the contact end cap.

19. The method of claim 15, wherein the portion of the toner hopper comprises a protruding edge formed on an exterior surface of the toner hopper.

20. The method of claim 15, wherein the retaining clip is unitary in shape.

* * * * *